US006863500B2

(12) United States Patent
Jung et al.

(10) Patent No.: US 6,863,500 B2
(45) Date of Patent: Mar. 8, 2005

(54) BLAST FAN

(75) Inventors: Young Gyu Jung, Inchun-si (KR); Chang Joon Kim, Seoul-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/397,227

(22) Filed: Mar. 27, 2003

(65) Prior Publication Data

US 2004/0033138 A1 Feb. 19, 2004

(30) Foreign Application Priority Data

Aug. 14, 2002 (KR) ..... 10-2002-0048005

(51) Int. Cl.[7] ..... F04D 29/38
(52) U.S. Cl. ..... 416/228; 415/218.1
(58) Field of Search ..... 416/228, 203, 416/175, 234; 415/218.1

(56) References Cited

U.S. PATENT DOCUMENTS 2,014,032 A * 9/1935 Sharpe et al. ..... 416/228
4,265,596 A * 5/1981 Katagiri et al. ..... 416/236 A
4,564,335 A * 1/1986 Harmsen et al. ..... 415/218.1
5,215,441 A * 6/1993 Evans et al. ..... 416/223 R

FOREIGN PATENT DOCUMENTS

DE 3017943 A * 11/1980 ..... F04D/29/68

* cited by examiner

*Primary Examiner*—Ninh H. Nguyen
(74) *Attorney, Agent, or Firm*—Greenblum & Bernstein, P.L.C.

(57) ABSTRACT

Disclosed is a blast fan for blowing air in a centrifugal direction thereof. The blast fan comprises a hub coupled to a rotating shaft of a motor, and a plurality of blades equally spaced and arranged around the outer peripheral surface of the hub. More particularly, the blast fan, of axial flow type or diagonal flow type, is configured so that turbo blades are integrally coupled to respective tips or trailing edges of the rotary blades. By achieving an optimal installation angle of the turbo blade, it is possible to achieve an increase in the flow rate and to reduce the level of noise generated.

14 Claims, 11 Drawing Sheets

BLAST FAN

BACKGROUND OF THE INVENTION

1. Field of the Invention

The present invention relates to a blast fan for blowing air in a centrifugal direction thereof, and more particularly to a blast fan having a plurality of turbo blades, each integrally installed to the tip or trailing edge of a rotary blade, for achieving an increase in the flow rate and a significant reduction in noise generated.

2. Description of the Related Art

In general, a blast fan is mounted to home electronics including refrigerators, air conditioners, microwave ovens and so on, and adapted to blow air while being rotated by a motor.

FIG. 1 is a front view showing the construction of a conventional axial flow fan, FIG. 2 is a side view of the conventional axial flow fan, and FIG. 3 is a sectional view showing the construction of a refrigerator equipped with the conventional axial flow fan.

The conventional axial flow fan, as shown in FIGS. 1 and 2, comprises a hub 2 coupled to a rotating shaft of a motor (not shown) and adapted to be rotated by the motor, and a plurality of rotary blades 4 equally spaced and arranged around the outer peripheral surface of the hub 2 for blowing air.

The axial flow fan 10, configured as stated above, is used in various electric units including refrigerators, air-conditioners, microwave ovens and so on. Now, a general operation of a refrigerator including the conventional axial flow fan will be described.

As shown in FIG. 3, the axial flow fan 10 is mounted within a flow channel, formed along one side of a freezing compartment F and refrigerating compartment R, and connected with a motor 12. The axial flow fan 10 serves to blow cooled air, passing through an evaporator 14 located at the bottom side of the freezing compartment F, toward the freezing compartment F or refrigerating compartment R.

In detail, as a compressor 16 and the axial flow fan 10 are operated, a coolant is circulated through the compressor 16, a condenser 18, a capillary tube (not shown) and the evaporator 14. During circulation, heat exchange takes place in the evaporator 14 to allow the coolant to provide the cooled air, which is subsequently supplied into the freezing compartment F and refrigerating compartment R by means of the axial flow fan 10, to thereby cool any food stored in the freezing compartment F or refrigerating compartment R.

The cooled air is circulated along the flow channel extending from the freezing compartment F to refrigerating compartment R, so that it exhibits a high air flow resistance against the flow channel. Due to this high air flow resistance, the axial flow fan 10, generally used in the refrigerator, has a relatively large size and must be rotated at a high speed.

These problems of the conventional axial flow fan 10 occur in other electric units including air-conditioners and microwave ovens as well as refrigerators. In conclusion, the high air flow resistance of the flow channel increases the size and rotation speed of the axial flow fan 10.

When the axial flow fan 10 is mounted in the flow channel exhibiting the high air flow resistance, the flow rate of the fan is reduced due to the high air flow resistance. Also, since the motor 12 has to be rotated at a high speed, the level of noise generated from the fan is increased.

Although a turbo fan, adapted to forcibly propel air, is applied to solve a high air flow resistance problem as stated above, it is still not sufficient to ensure a high flow rate.

Where the blast fan is a kind of low static pressure and high flow rate type axial flow fan, which is adapted to achieve a wide range of flow rates in accordance with a pressure variation, the flow rate of the fan is reduced and the level of noise generated is increased according to an increase in air flow resistance. Where the conventional blast fan is a kind of high static pressure and low flow rate type turbo fan, which is advantageously used under the high air flow resistance condition, it still fails to blow a large amount of air.

SUMMARY OF THE INVENTION

Therefore, the present invention has been made in view of the above problems, and it is an object of the present invention to provide a blast fan comprising a plurality of turbo blades, each integrally installed at an optimal position of a rotary blade, thereby achieving an increase in the flow rate of the fan and a reduction in noise generated from the fan, even in the case that the blast fan is mounted in a flow channel exhibiting a relatively high air flow resistance.

In accordance with one aspect of the present invention, the above and other objects can be accomplished by the provision of a blast fan comprising: a cylindrical hub coupled to a rotating shaft of a motor, and having a horizontally extending outer peripheral surface configured so that the both ends thereof have the same diameter; a plurality of rotary blades equally spaced and arranged around the outer peripheral surface of the hub; and a plurality of turbo blades integrally formed to respective tips or trailing edges of selected ones of the rotary blades.

In accordance with another aspect of the present invention, the above and other objects can be accomplished by the provision of a blast fan comprising: a hub coupled to a rotating shaft of a motor and having an inclined outer peripheral surface configured so that an inlet end thereof adapted to suck air has a smaller diameter than an outlet end thereof adapted to discharge the sucked air; a plurality of rotary blades equally spaced and arranged around the outer peripheral surface of the hub; and a plurality of turbo blades integrally coupled to respective tips or trailing edges of selected ones of the rotary blades.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
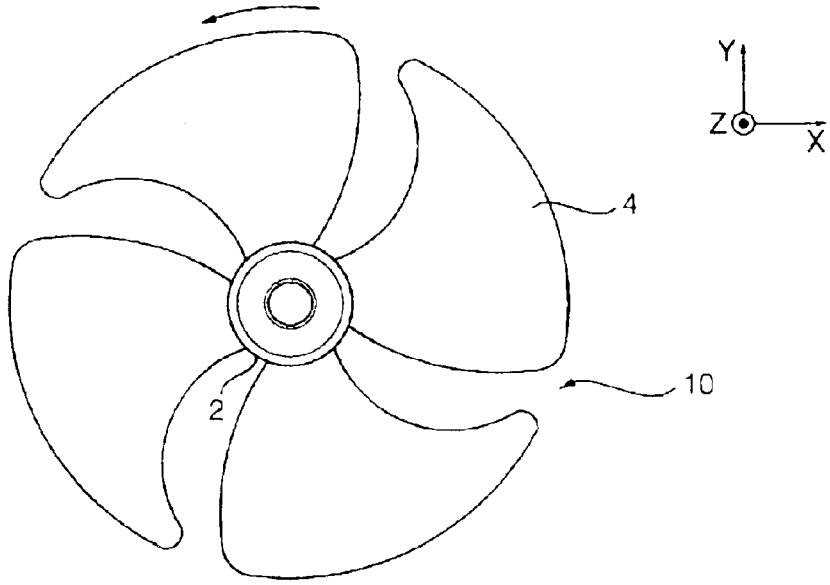
Fig. 1(Prior Art)
FIG. 1 is a front view showing the construction of a conventional axial flow fan.
Figure 2:
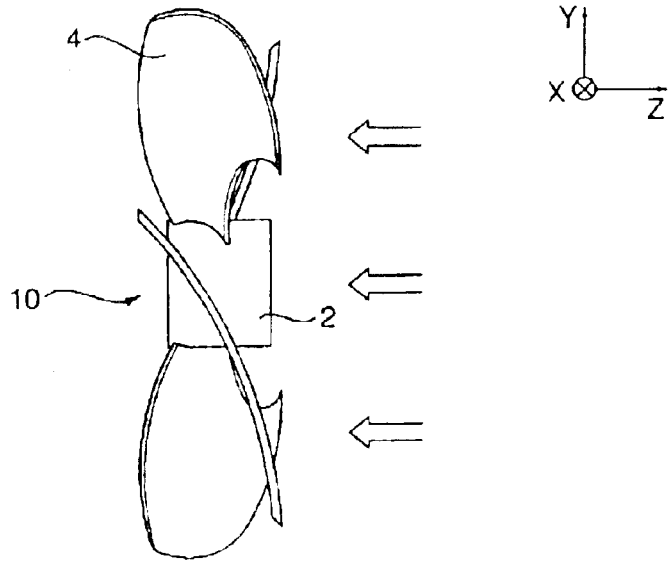
Fig. 2(Prior Art)
FIG. 2 is a side view of the conventional axial flow fan.
Figure 3:
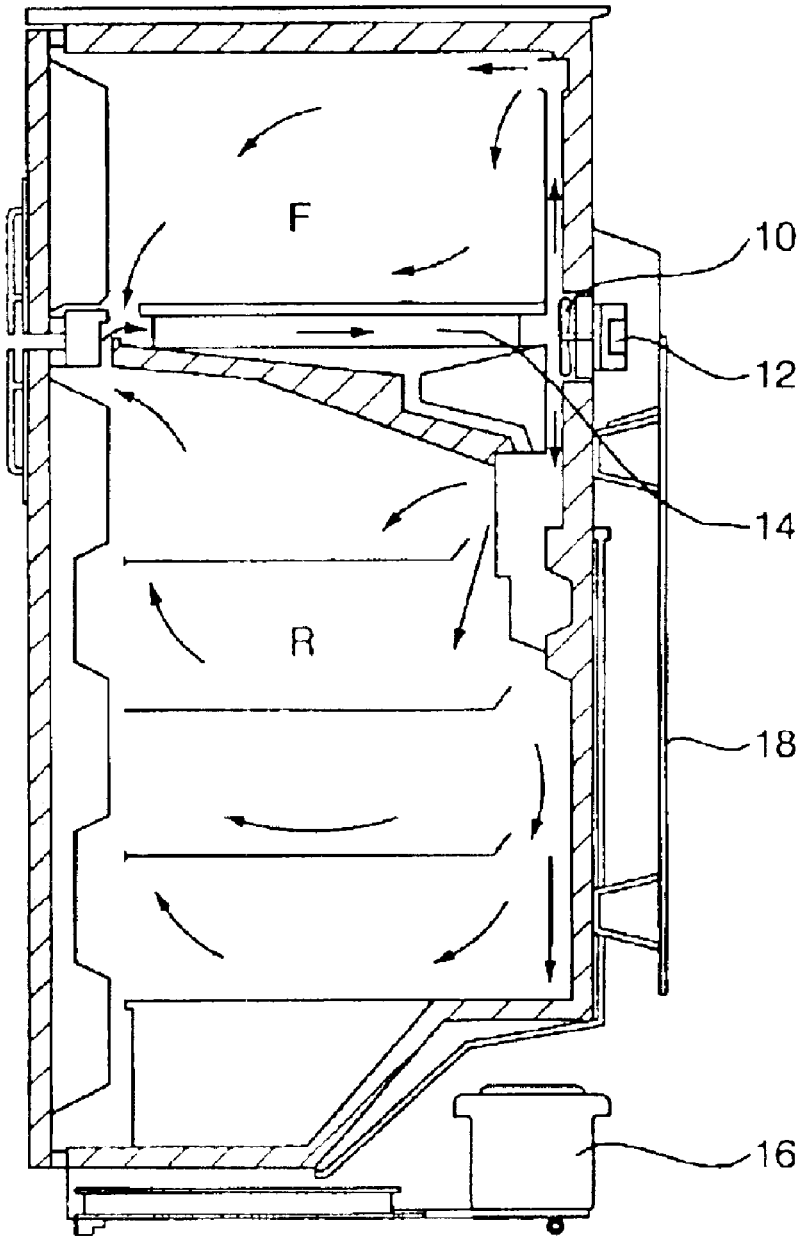
Fig. 3(Prior Art)
FIG. 3 is a sectional view showing the construction of a refrigerator equipped with the conventional axial flow fan.
Figure 4:
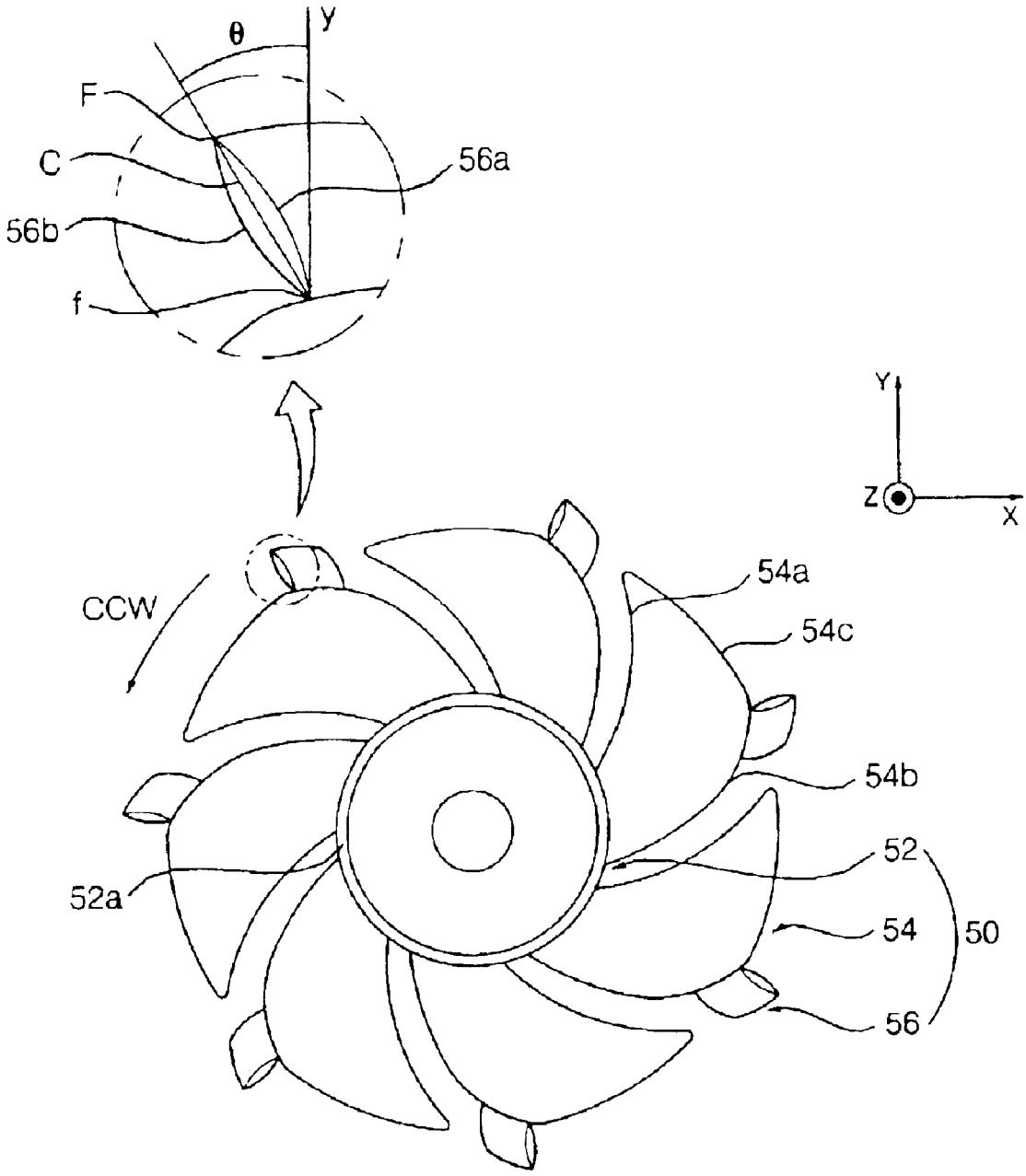
FIGS. 4 and 5 are a front view and a side view, respectively, showing the construction of an axial flow fan (CCW) in accordance with the present invention.
Figure 5:
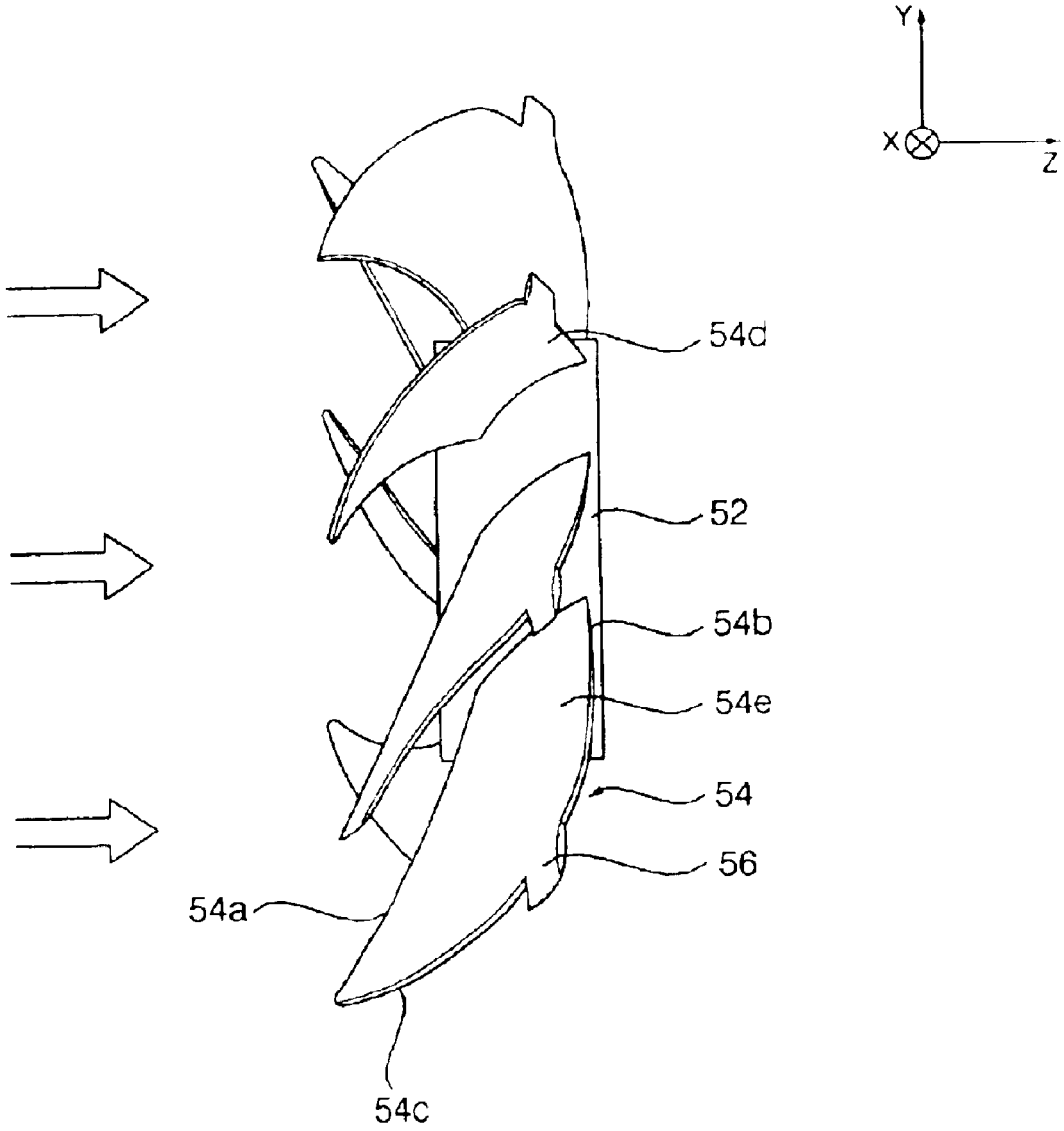
Figure 6:
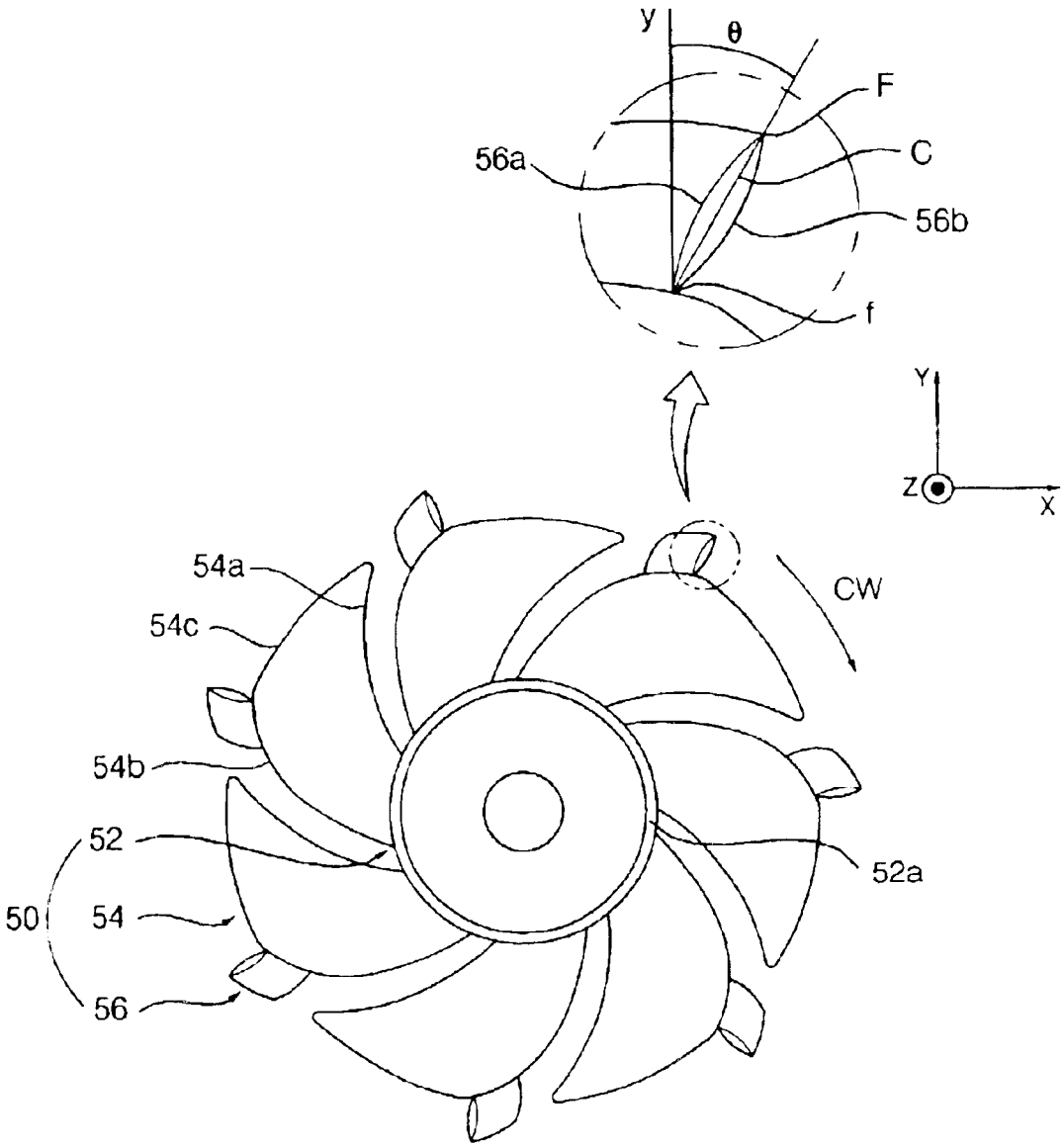
FIGS. 6 and 7 are a front view and a side view, respectively, showing the construction of the axial flow fan (CW) in accordance with the present invention.
Figure 7:
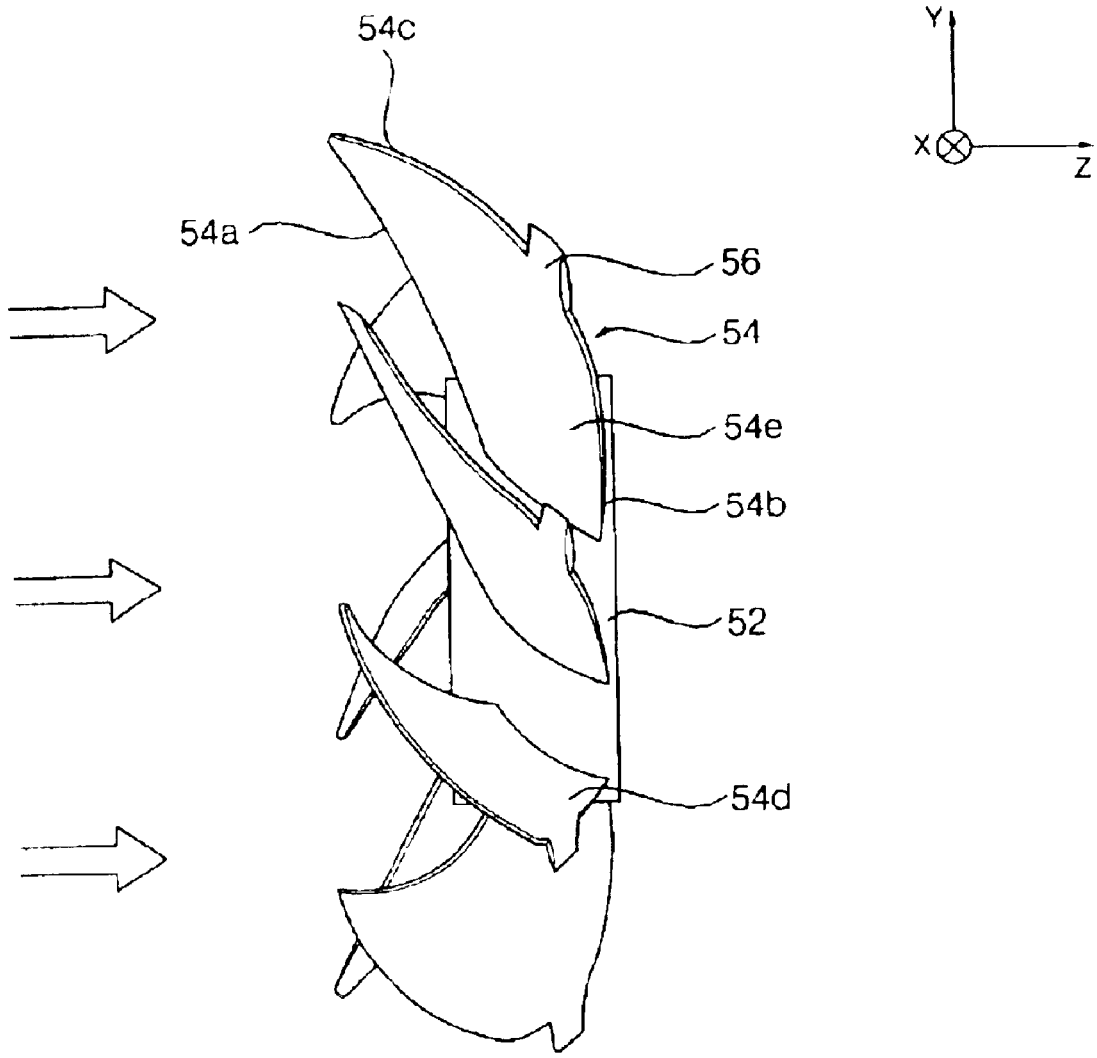

FIGS. 4 and 5 are a front view and a side view, respectively, showing the construction of a blast fan (CCW) in accordance with the present invention, and FIGS. 6 and 7 are a front view and a side view, respectively, showing the construction of the blast fan (CW) of the present invention.

The blast fan in accordance with the present invention is of axial flow type as shown in FIGS. 4 to 7. The axial flow fan 50 comprises a cylindrical hub 52 coupled to a rotating shaft of a motor (not shown) and having a horizontally extending outer peripheral surface 52*a* configured so that an inlet end thereof adapted to suck air has the same diameter as an outlet end thereof adapted to discharge the sucked air. The axial flow fan 50 further comprises a plurality of rotary blades 54 equally spaced and arranged around the outer peripheral surface 52*a* of the hub 52, and a plurality of turbo blades 56 integrally coupled with the rotary blades 54, respectively.

The hub 52 has a rotating shaft mount 52*b* arranged inside the outer peripheral surface 52*a*. The rotating shaft mount 52*b* is connected with the outer peripheral surface 52*a* of the hub 52 and adapted to fit the rotating shaft of the motor therein. The turbo blades 56 are integrally coupled to the rotary blades 54, respectively.

Each rotary blade 54 has a leading edge 54*a* positioned at a front portion thereof when viewed in a rotating direction of the axial flow fan 50 to suck air, a trailing edge 54*b* positioned at a rear portion thereof opposite to the leading edge 54*a* to discharge the sucked air, and a tip 54*c* formed as a peripheral portion connecting the upper ends of the leading edge 54*a* and trailing edge 54*b*.

The rotary blade 54 has an intermediate curved portion between the leading edge 54*a* and trailing edge 54*b*. The intermediate curved portion of the rotary blade 54 has a certain curvature such that the trailing edge 54*b* is positioned closer to the outlet end of the hub 52, than the leading edge 54*a*. The rotary blade 54 further has a pressure surface 54*d* adapted to suck air, and a negative pressure surface 54*e* opposite to the pressure surface 54*d*.

Each turbo blade 56 is fixed to the tip 54*c* or trailing edge 54*b* of the associated rotary blade 54. As the number of the rotary blades 54 is increased, the turbo blade 56 is installed closer to the trailing edge 54*b*.

Now, the turbo blade 56 will be explained fully in relation to an installation position thereof. When the axial flow fan 50 is configured to rotate in a counterclockwise direction CCW when viewed from the pressure surface 54*d* of the rotary blade 54, the turbo blade 56 has an installation angle (θ) within a range of −50° to 20°, as shown in FIG. 4.

When the axial flow fan is configured to rotate in a clockwise direction CW when viewed from the pressure surface 54*d* of the rotary blade 54, the turbo blade 56 has an installation angle (θ) within a range of −20° to 50°, as shown in FIG. 6.

The turbo blade 56 has a longitudinal cross section while having a pressure surface 56*a* adapted to suck air at one side of the longitudinal cross section, and a negative pressure surface 56*b* opposite to the pressure surface 56*a* at the other side of the longitudinal cross section. The pressure surface 56*a* and negative pressure surface 56*b* meet at their top and bottom edges, respectively. A Y-axis is a straight line connecting a center (bo) of the blade portion met with the hub (52) and a center (ho) the of hub. The top edge forms an outer point F of the turbo blade 56, and the bottom edge forms an inner point f of the turbo blade 56. A vertical y-axis is parallel to the Y-axis and passes through said inner point of the turbo blade. By connecting the inner and outer points f and F, a central axis C is obtained in relation with the longitudinal cross section of the turbo blade 56. The installation angle (θ) is an angle defined between the central axis C and the vertical y-axis.

Where the central axis C of the longitudinal cross section is inclined in the clockwise direction CW with respect to the vertical y-axis, the installation angle (θ) is defined as a positive angle. Where the central axis C is inclined in the counter-clockwise direction CCW with respect to the vertical y-axis, the installation angle (θ) is defined as a negative angle.

Figure 8:
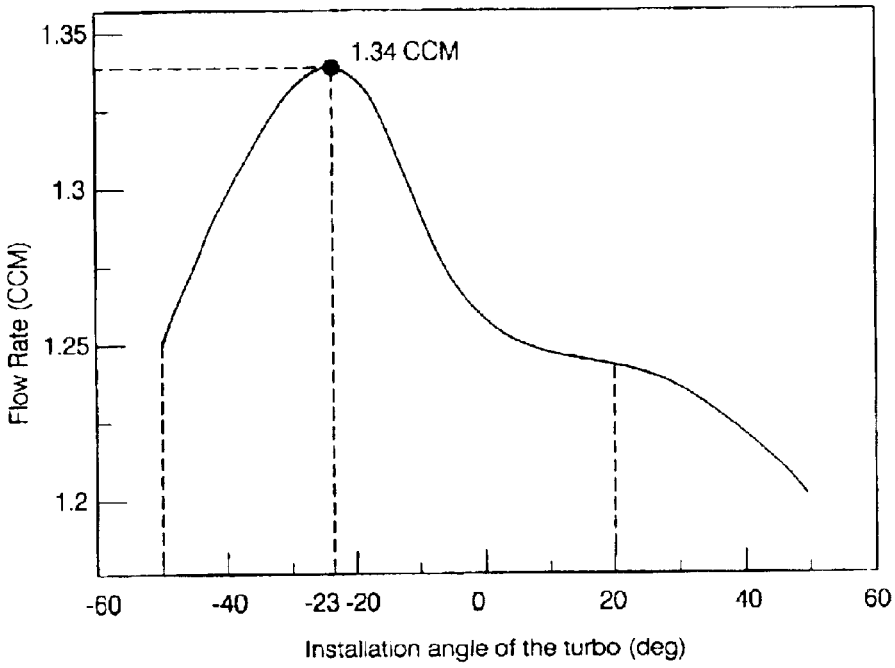
FIG. 8 is a graph for comparing a variation in flow rate with a variation in installation angle of turbo blades in the axial flow fan of the present invention.
Figure 9:
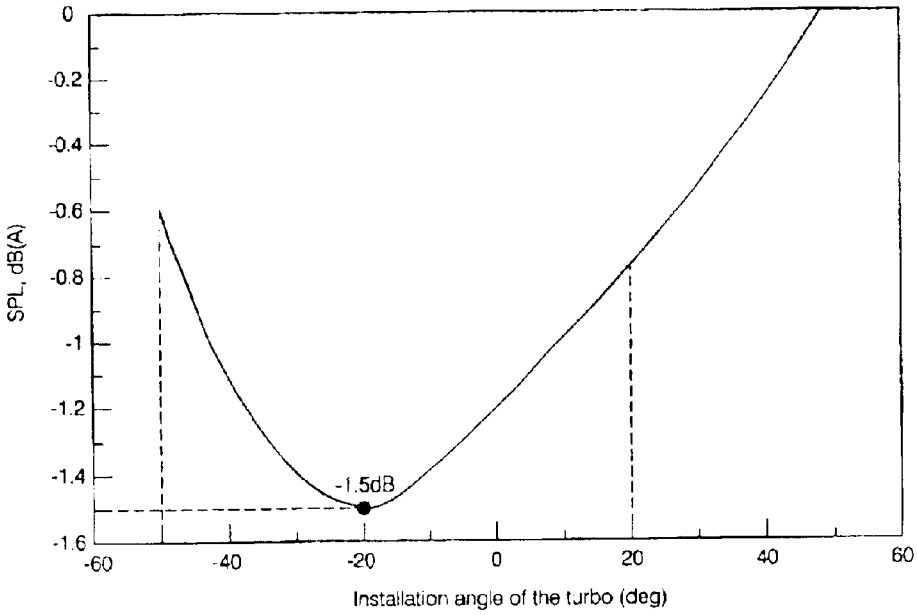
FIG. 9 is a graph for comparing a variation in the level of noise with a variation in installation angle of the turbo blades in the axial flow fan of the present invention.

FIG. 8 is a graph for comparing a variation in flow rate with a variation in installation angle of the turbo blades in the axial flow fan of the present invention, and FIG. 9 is a graph for comparing a variation in the level of noise produced by the axial flow fan of the present invention with a variation in installation angle of the turbo blades thereof.

Now, the axial flow fan 50 having the turbo blade 56 will be explained fully in relation to a performance thereof. As shown in FIG. 8, it can be found that the axial flow fan 50 achieves an optimal flow rate of 1.34 CCM at the installation angle (θ) of about −23°. That is, as the installation angle (θ) of the turbo blade 56 is increased or decreased from about −23° as a center point, the flow rate of the axial flow fan 50 is reduced. Also, as shown in FIG. 9, it can be found that the axial flow fan 50 achieves an optimal noise level of −1.5 dB at the installation angle (θ) of about −20°. That is, as the installation angle (θ) of the turbo blade 56 is increased or decreased from about −20° as a center point, the generation of noise is increased.

Therefore, in the axial flow fan 50 adapted to rotate in the counterclockwise direction CCW when viewed from the pressure surface 54*d* of the rotary blade 54, it is possible to achieve a maximum flow rate and to efficiently reduce the level of noise at the installation angle (θ) of −20°±5°.

In the axial flow fan 50 adapted to rotate in the clockwise direction CW when viewed from the pressure surface 54*d* of the rotary blade 54, it is possible to achieve a maximum flow rate and to efficiently reduce the level of noise at the installation angle (θ) of 20°±5°.

Figure 10:
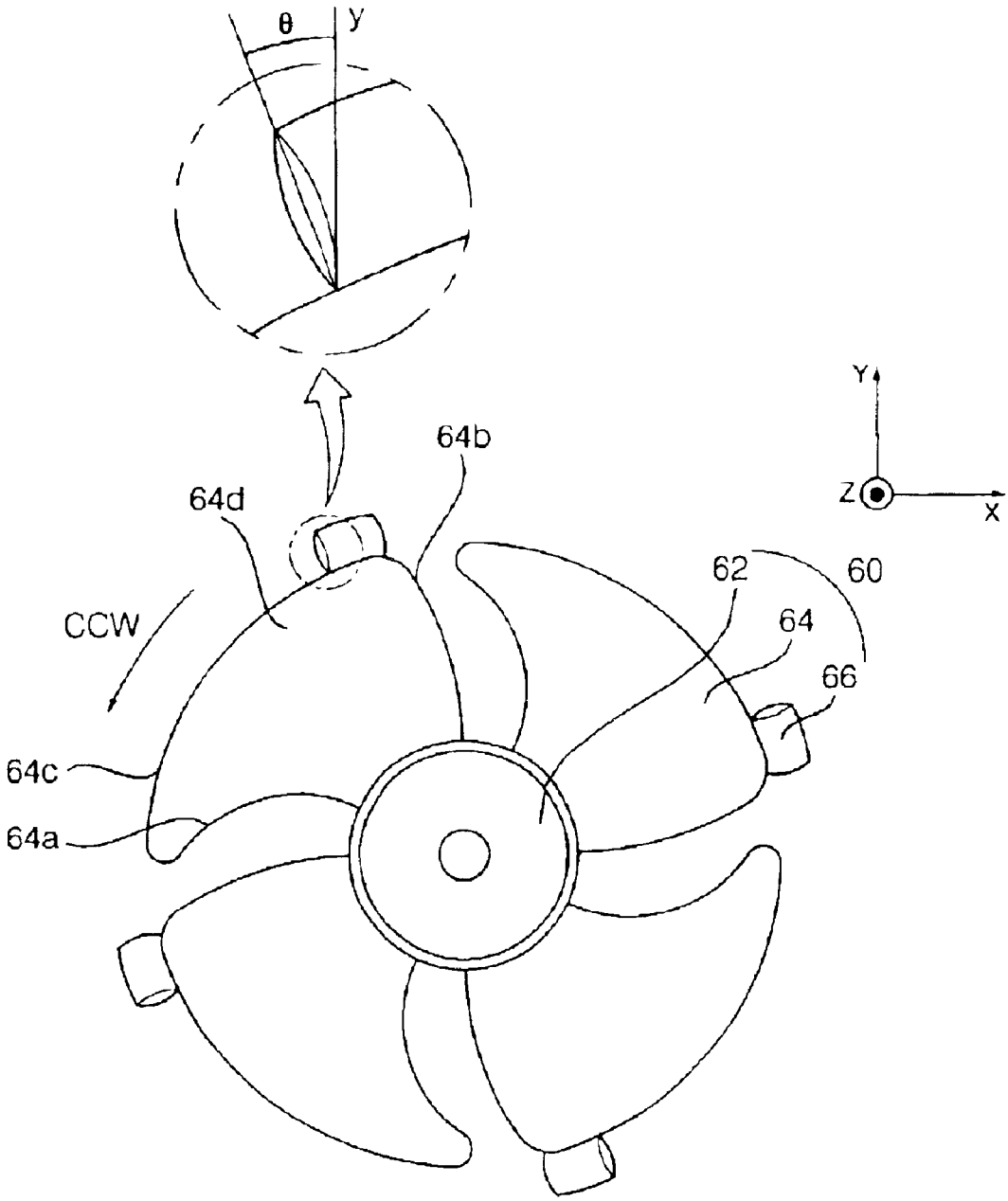
FIGS. 10 and 11 are a front view and a side view, respectively, showing the construction of a diagonal flow fan (CCW) in accordance with the present invention.
Figure 11:
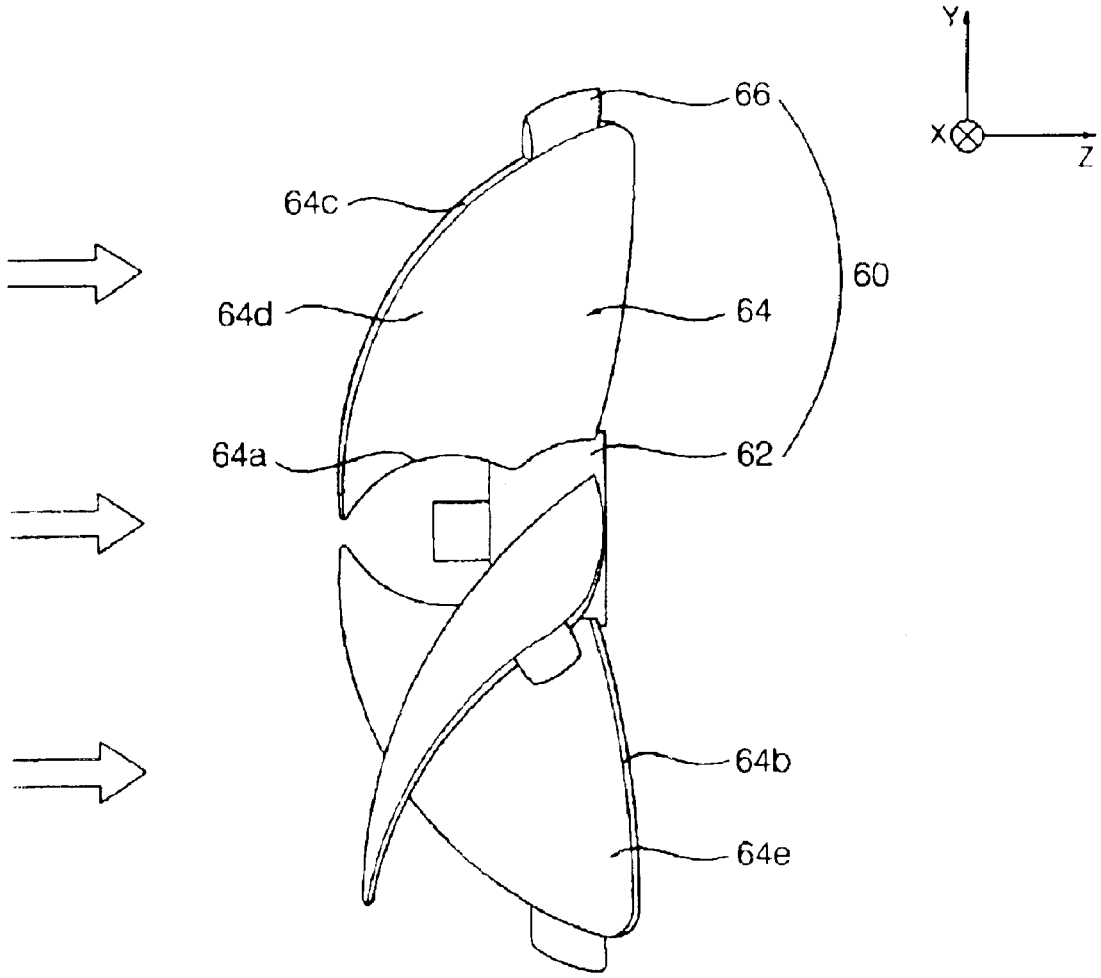
Figure 12:
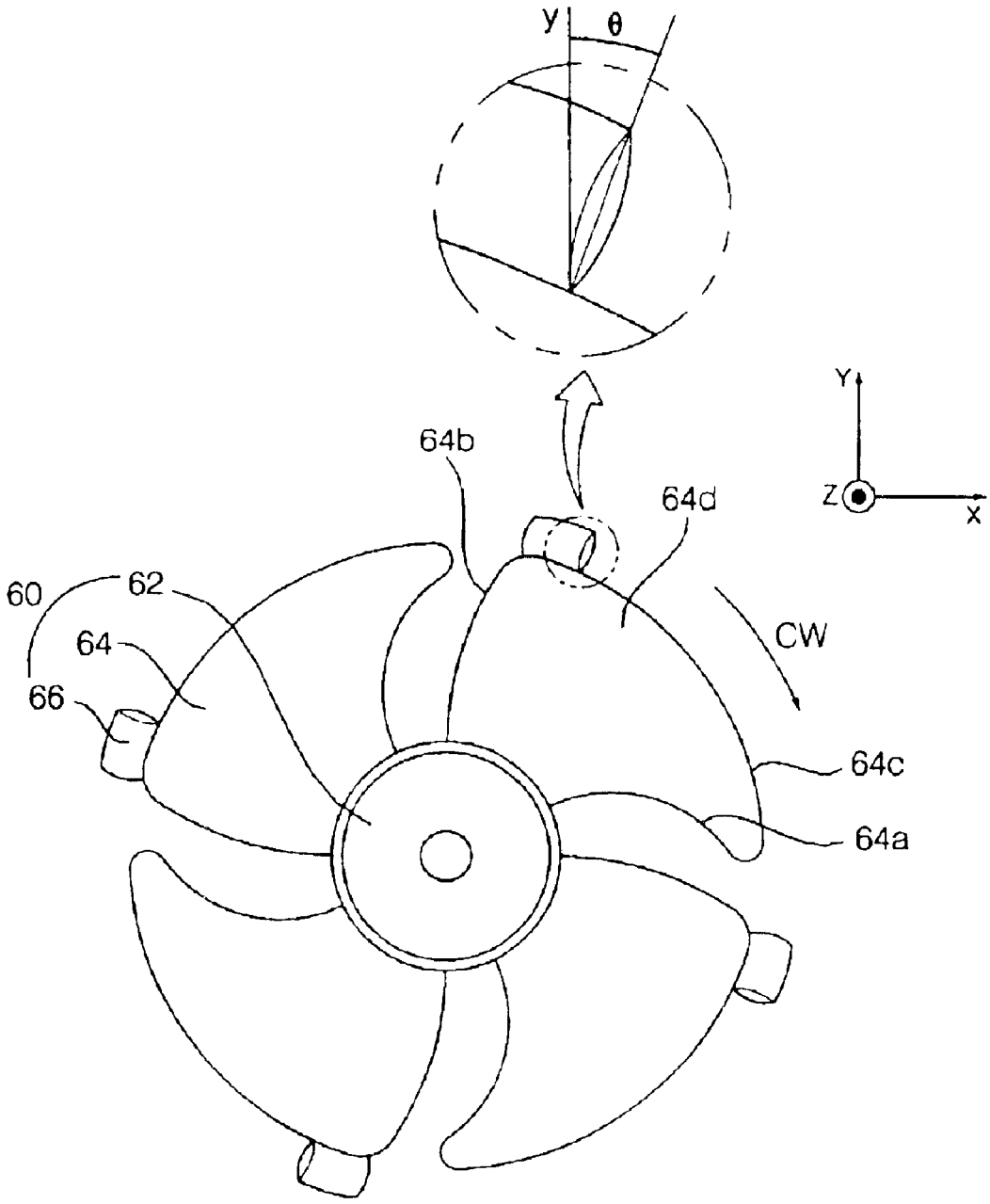
FIGS. 12 and 13 are a front view and a side view, respectively, showing the construction of the diagonal flow fan (CW) in accordance with the present invention.
Figure 13:
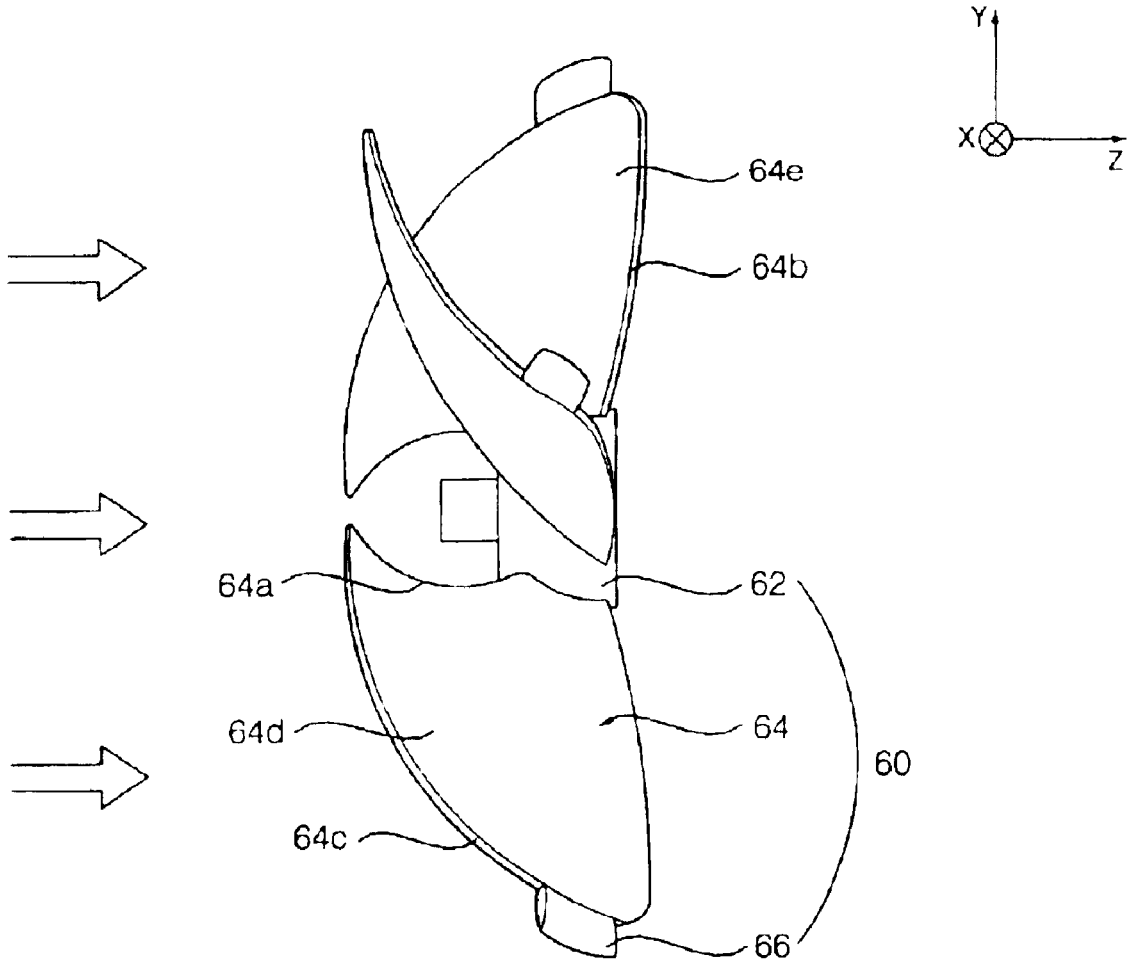

FIGS. 10 and 11 are a front view and a side view, respectively, showing the construction of a blast fan (CCW) in accordance with the present invention, and FIGS. 12 and 13 are a front view and a side view, respectively, showing the blast fan (CW) of the present invention.

The blast fan in accordance with the present invention is of diagonal flow type as shown in FIGS. 10 to 13. The diagonal flow fan 60 comprises a hub 62 coupled to a rotating shaft of a motor (not shown), a plurality of rotary blades 64 equally spaced and arranged around the outer peripheral surface of the hub 62, and a plurality of turbo blades 66 integral with each of the rotary blades 64. The outer peripheral surface of the hub 62 is inclined so that the inlet end thereof adapted to suck air has a smaller diameter than the outlet end thereof adapted to discharge the sucked air.

Each turbo blade 66 is fixed to a tip 64*c* or trailing edge 64*b* of the associated rotary blade 64. When the rotary blade 64 is rotated in a counterclockwise direction CCW when viewed from the pressure surface 64*d* thereof, the turbo blade 66 has an installation angle (θ) within a range of −50° to 20°, as shown in FIG. 10. When the rotary blade 64 is rotated in a clockwise direction CW when viewed from the pressure surface 64*d* thereof, the turbo blade 66 has an installation angle (θ) within a range of −20° to 50°, as shown in FIG. 12.

In the diagonal flow fan 60 configured as stated above, the turbo blade 66 has the same optimal installation angle (θ) as that of the axial flow fan 50. That is, when the rotary blade 64 is rotated in the counterclockwise direction CCW when viewed from the pressure surface 64*d*, the optimal installation angle (θ) of the turbo blade 66 is in a range of −20°−5°. When the rotary blade 64 is rotated in the clockwise direction CW when viewed from the pressure surface 64*d*, the optimal installation angle (θ) is in a range of 20°±5°.

The reference number 64*a* denotes a leading edge of the rotary blade 64, and the reference number 64*e* denotes a negative pressure surface of the blade 64.

Hereinafter, the operation of the axial flow fan or diagonal flow fan in accordance with the present invention will be explained.

Firstly, electric power is applied to the motor adapted to drive the hub 52 or 62 coupled to the rotating shaft of the motor, so that the rotary blades 54 or 64 and turbo blades 56 or 66 fixed to the hub 52 or 62 are rotated together.

During the rotation of the rotary blades 54 or 64 for sucking air from the inlet end of the hub 52 or 62, the sucked air is divided by the leading edge 54*a* or 64*a* of the rotary blade 54 or 64 to flow over the pressure surface 54*d* or 64*d* and the negative pressure surface 54*e* or 64*e*, respectively, and then is discharged from the trailing edge 54*c* or 64*c*.

Between the pressure surface 54*d* or 64*d* and the negative pressure surface 54*e* or 64*e* a certain amount of pressure difference is produced. This pressure difference causes an increase in the static pressure of the sucked air according to Bernoulli's equation. Consequently, the fan creates a thrust force of air in a direction perpendicular to the rotating direction of the blast fan 50 or 60, namely, in a centrifugal direction of the fan.

Then, the sucked air passing through the rotary blades 54 or 64 is discharged in a radial direction of the rotary blades 54 or 64 due to a centrifugal force produced according to the rotation thereof, so that it passes through the turbo blades 56 or 66 attached to the tips 54*c* or 64*c* or trailing edges 54*b* or 64*b* of the rotary blades 54 or 64. During passage of the turbo blades 56 or 66, the air is forcibly propelled, and then flows along the flow channel after being completely discharged from the blast fan 50 or 60.

As stated above, the blast fan in accordance with the present invention has advantages of a general axial flow fan or diagonal flow fan as well as a turbo fan. That is, the blast fan can create a high flow rate, like a general axial flow fan or diagonal flow fan configured so that a flow rate thereof can respond sensitively to a pressure variation. Also, the blast fan can create a high static pressure of air, like a turbo fan adapted to forcibly propel the air, even though the blast fan is mounted in the flow channel exhibiting a relatively high air flow resistance.

As apparent from the above description, the present invention provides a blast fan having turbo blades, each integrally formed at a desired installation angle to the tip or trailing edge of each of a rotary blade in axial flow fan or diagonal flow fan. Thus, it is possible to generate a high flow rate as well as a high static pressure of air.

Therefore, even though the blast fan is installed in the flow channel exhibiting a relatively high air flow resistance, it is possible to increase the flow rate of the fan and reduce the level of noise generated by the fan. Furthermore, it is possible to increase the operational reliability of products equipped with the blast fan as stated above.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A blast fan comprising:

a cylindrical hub coupled to a rotating shaft of a motor, the hub having a horizontally extending outer peripheral surface configured so that both ends thereof have the same diameter;

a plurality of rotary blades equally spaced and arranged around the outer peripheral surface of the hub; and a plurality of turbo blades coupled to respective tips of at least more than one of the rotary blades, wherein the blast fan is rotated in counterclockwise direction CCW when viewed from a pressure surface of the rotary blade.

2. The blast fan as set forth in claim 1, wherein the turbo blades are integrally coupled to the rotary blades, respectively.

3. The blast fan as set forth in claim 1, wherein the position of a turbo blade alone a peripheral surface of a rotary blade is related to the number of rotary blades, the turbo blade being positioned closer to a trailing edge of a rotary blade, as the number of the rotary blades increases, the turbo blade having a longitudinal cross section with a central axis inclined within a range of −50° to 20° with respect to a vertical y-axis.

4. The blast fan as set forth in claim 1, wherein the turbo blade has a longitudinal cross section with a central axis inclined within a range of −20°±5° with respect to a vertical y-axis.

5. A blast fan comprising:

a hub coupled to a rotating shaft of a motor, the hub having an inclined outer peripheral surface configured so that the an air inlet end thereof has a smaller diameter than an air outlet end thereof;

a plurality of rotary blades equally spaced and arranged around the outer peripheral surface of the hub; and a plurality of turbo blades coupled to respective tips of at least more than one of the rotary blades, wherein the blast fan is rotated in counterclockwise direction CCW when viewed from a pressure surface of the rotary blade.

6. The blast fan as set forth in claim 5, wherein the turbo blades are integrally coupled to the rotary blades, respectively.

7. The blast fan as set forth in claim 5, wherein the position of a turbo blade along a peripheral surface of a rotary blade is related to the number of rotary blades, the turbo blade being positioned closer to a trailing edge of a rotary blade, as the number of the rotary blades increases, the turbo blade having a longitudinal cross section with a central axis inclined within a range of −50° to 20° with respect to a vertical y-axis.

8. The blast fan as set forth in claim 5, wherein the turbo blade has a longitudinal cross section with a central axis inclined within a range of −20°±5° with respect to a vertical y-axis.

9. A blast fan comprising:

a cylindrical hub coupled to a rotating shaft of a motor, the hub having a horizontally extending outer peripheral surface configured so that both ends thereof have the same diameter;

a plurality of rotary blades equally spaced and arranged around the outer peripheral surface of the hub; and a plurality of turbo blades coupled to respective trailing edges of at least more than one of the rotary blades, wherein the blast fan is rotated in counterclockwise direction CCW when viewed from a pressure surface of the rotary blade.

10. The blast fan as set forth in claim 9, wherein the turbo blade has a longitudinal cross section with a central axis inclined within a range of −50° to 20° with respect to a vertical y-axis.

11. The blast fan as set forth in claim 10, wherein the turbo blade has a longitudinal cross section with a central axis inclined within a range of −20°±5° with respect to a vertical y-axis.

12. A blast fan comprising:

a hub coupled to a rotating shaft of a motor, the hub having an inclined outer peripheral surface configured so that the an air inlet end thereof has a smaller diameter than an air outlet end thereof;

a plurality of rotary blades equally spaced and arranged around the outer peripheral surface of the hub; and a plurality of turbo blades coupled to respective trailing edges of at least more than one of the rotary blades, wherein the blast fan is rotated in counterclockwise direction CCW when viewed from a pressure surface of the rotary blade.

13. The blast fan as set forth in claim 12, wherein the turbo blade has a longitudinal cross section with a central axis inclined within a range of −50° to 20° with respect to a vertical y-axis.

14. The blast fan as set forth in claim 13, wherein the turbo blade has a longitudinal cross section with a central axis inclined within a range of −20°±5° with respect to a vertical y-axis.

* * * * *

UNITED STATES PATENT AND TRADEMARK OFFICE

CERTIFICATE OF CORRECTION

PATENT NO. : 6,863,500 B2
DATED : March 8, 2005
INVENTOR(S) : Y. G. Jung et al.

It is certified that error appears in the above-identified patent and that said Letters Patent is hereby corrected as shown below:

Column 6,
Line 31, “alone” should be -- along --.

Signed and Sealed this

First Day of November, 2005

JON W. DUDAS
*Director of the United States Patent and Trademark Office*